US007020915B1

(12) United States Patent
Helsdon

(10) Patent No.: US 7,020,915 B1
(45) Date of Patent: Apr. 4, 2006

(54) HAMMOCK

(76) Inventor: David Helsdon, R.R. #1, Straffordville, Ontario (CA) N0J 1Y0

( * ) Notice: Subject to any disclaimer, the term of this patent is extended or adjusted under 35 U.S.C. 154(b) by 0 days.

(21) Appl. No.: 11/133,174

(22) Filed: May 20, 2005

(51) Int. Cl.
*A45F 3/22* (2006.01)

(52) U.S. Cl. ..... 5/121; 5/122; 5/123; 5/127

(58) Field of Classification Search ..... 5/120–123, 5/127, 128
See application file for complete search history.

(56) References Cited

U.S. PATENT DOCUMENTS

| | | | | | |
|---|---|---|---|---|---|
| 202,814 | A | | 4/1878 | Hanks | |
| 249,403 | A | | 11/1881 | Robertson | |
| 645,805 | A | | 3/1900 | Graham | |
| 688,029 | A | * | 12/1901 | Palmer | 5/121 |
| 717,119 | A | * | 12/1902 | Potter | 5/122 |
| 1,543,814 | A | | 6/1925 | Banning | |
| 2,375,792 | A | * | 5/1945 | Kearny | 5/121 |
| 4,001,902 | A | * | 1/1977 | Hall et al. | 5/121 |
| 4,021,868 | A | | 5/1977 | Fueslein | |
| 4,308,883 | A | * | 1/1982 | Malone | 135/90 |
| 5,715,552 | A | * | 2/1998 | DeAth | 5/123 |
| 5,913,772 | A | * | 6/1999 | Clark | 5/121 |
| 6,701,549 | B1 | * | 3/2004 | Eriksen | 5/120 |
| 2002/0042951 | A1 | | 4/2002 | Hennessy | |
| 2004/0006820 | A1 | | 1/2004 | Saiki | |

OTHER PUBLICATIONS http://www.myhammock.com/campinghammocks~ns4.html The Hammock Source, Dec. 2, 2004.

http://www.junglehammock.com/tests.html Clark Jungle Hammock—Field Tester Reports, 1997.

Helsdon, David, "Chrysalis", 2002.

* cited by examiner

*Primary Examiner*—Michael Trettel
(74) *Attorney, Agent, or Firm*—Anissimoff & Associates; Hans Koenig

(57) ABSTRACT

A hammock has a bed formed from a blank of flexible fabric. The blank is defined by opposed ends and opposed sides, the ends and sides of the blank coinciding with opposed ends and opposed side edges of the hammock respectively. Each side of the blank tapers inwardly from the ends, each end of the blank has a notch having opposed edges of equal length. The opposed edges of each notch taper inwardly from the end towards an apex. The opposed edges of each notch are attached by a seam to form the bed from the blank. Cross-braces proximal the ends of the hammock are connected to the side edges of the hammock at connection points opposed across the bed from one side edge to the opposite side edge. The fabric hangs underneath the cross-braces so that an occupant may rest level on the bed fully under the cross-braces. The hammock is suspended between upright structures, such as trees or posts, using a special connection involving a cargo hook having a hook portion and a ring portion. A special cam buckle having a slot is used to facilitate suspending and taking down the hammock. The hammock provides a very comfortable, stable and level sleeping position. The hammock may be provided with a bug screen and/or tent supported by a supporting system. The tent is constructed of separate sections that surround the hammock in use.

20 Claims, 12 Drawing Sheets

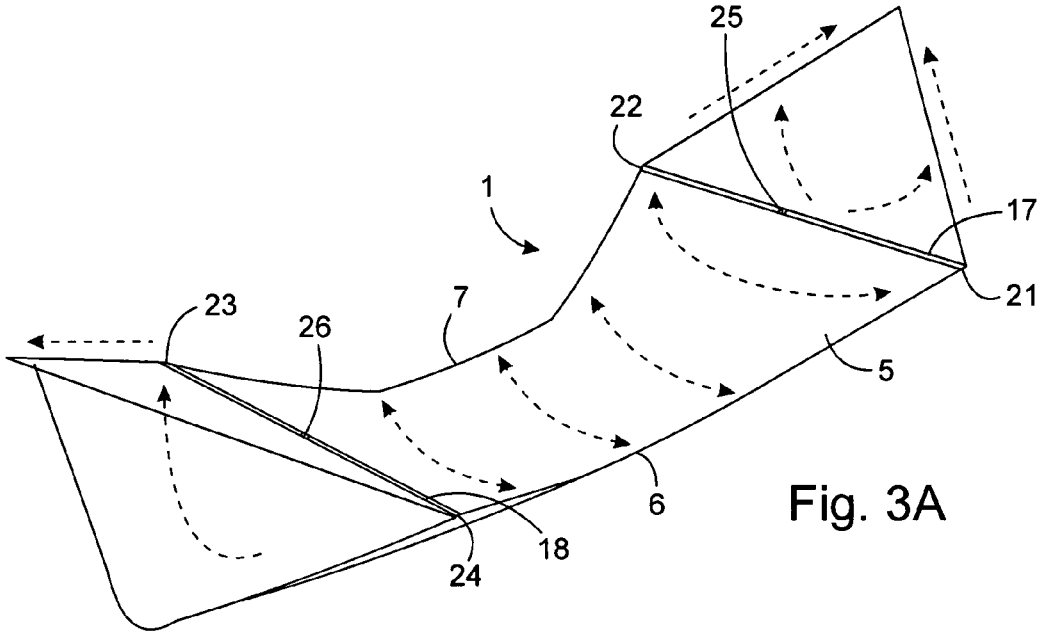
Fig. 3A
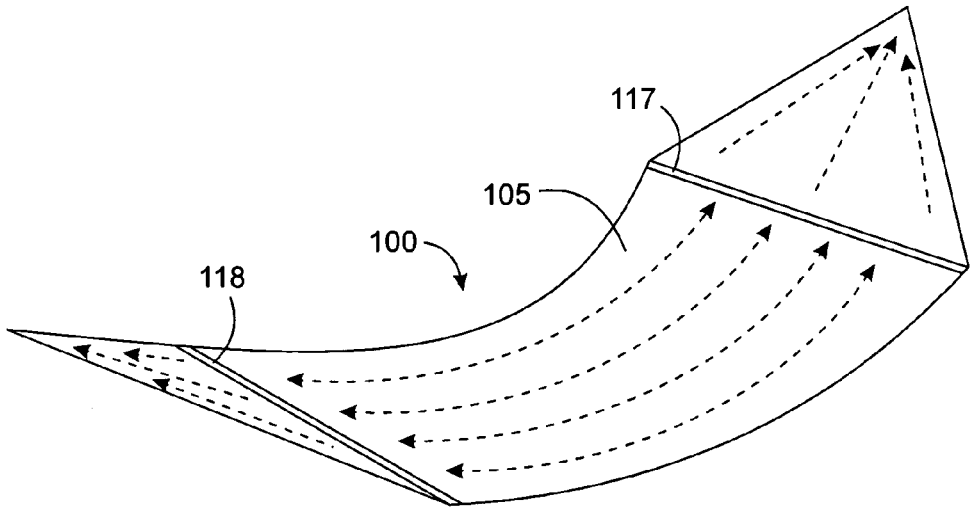
FIG. 3B - Prior Art

HAMMOCK

FIELD OF THE INVENTION

The present invention relates to hammocks.

BACKGROUND OF THE INVENTION

Hammocks provide a surface suspended between upright structures (e.g. trees, posts, etc.) on which a person may lie suspended above the ground. Hammocks are typically constructed of a sheet of material, often flexible (e.g. canvas, netting, ropes, etc.) gathered at the ends and suspended from upright structures by ropes, straps or like means.

One drawback of traditional hammocks is known as hammock sag, whereby the middle of the hammock sags below the ends creating a curved supporting surface. Such a surface is uncomfortable for an occupant as it does not follow the natural profile that the person's body will take when lying down. Furthermore, traditional hammocks provide no lumbar support or support under the knees and they are unstable and prone to tipping.

There have been a number of attempts to provide so-called self-leveling hammocks in an effort to ameliorate the problem. For example, Brazilian hammocks provide an extra wide sleeping surface so that a person may lie diagonally. Such hammocks require extra material and an occupant must be careful not to move into a non-diagonal position. U.S. Pat. No. 6,701,549, U.S. Pat. No. 645,805, U.S. Pat. No. 249,403, U.S. Pat. No. 202,814, U.S. 2002/0042951 and U.S. 2004/0006820 all describe various ways of compensating for hammock sag. None of these has been wholly successful at providing a comfortable, stable sleeping surface in a portable, easy to set-up hammock.

SUMMARY OF THE INVENTION

A hammock comprising: a bed formed from a blank of flexible fabric, the blank defined by opposed ends and opposed sides, the ends and sides of the blank coinciding with opposed ends and opposed side edges of the hammock respectively, each side of the blank tapering inwardly from the ends, each end of the blank having a notch having opposed edges of equal length, the opposed edges of each notch tapering inwardly from the end towards an apex, a seam attaching the opposed edges of each notch to form the bed from the blank; cross-braces proximal the ends of the hammock, each cross-brace connected to the side edges of the hammock at connection points opposed across the bed from one side edge to the opposite side edge, the fabric hanging underneath the cross-braces so that an occupant may rest level on the bed fully under the cross-braces; and, connecting means at each end of he hammock for connecting the hammock to suspending means for suspending the hammock between upright structures.

The flexible fabric may comprise any suitable flexible material, for example, fabrics comprising polyester, canvas, nylon, etc. Fabrics may be sheets of closely woven fibers or loosely woven nets or meshes. The fabric may comprise two or more separate fabrics linked together or, preferably, the fabric comprises a single piece. Preferably, the flexible fabric comprises a strong, lightweight, waterproof fabric, for example a polyester or polyester/nylon blend.

The bed may be formed from a blank of the flexible fabric cut into a shape and then attached in a manner to form the bed of the hammock. The blank is defined by opposed ends and opposed sides. The opposed sides each taper inwardly from the ends towards a middle portion of the blank. Thus, the ends of the blank are wider than the middle portion. Each end has a notch cut out with opposed edges of the notch tapering inwardly from the end toward an apex. The opposed edges of each notch preferably meet at the apex on a longitudinal axis on a centerline of the blank.

To form the bed from the blank, the opposed edges of each notch are attached to form a seam. The seam may be created, for example, by sewing, gluing or stapling the opposed edges together. As a result, the fabric forms the bed of he hammock in which the ends of the blank coincide with opposed ends of the hammock and the sides of the blank coincide with opposed side edges of the hammock. Since the fabric must be folded in order to create the seams, the bed acquires a three-dimensional structure and the side edges meet at the ends to form a rim all around the bed.

The sides of the blank taper inwardly towards the middle portion. The opposed sides may follow a straight line to the middle portion and then turn to become parallel. Alternatively, the sides may be scalloped along all or a portion of their length provided the sides taper inwardly from the ends to the middle portion. Preferably, the sides are selectively scalloped. Scalloping the sides of the blank changes the amount of tension experienced by various portions of the bed once the seams are formed. In this way, the bed can be contoured to improve support in key areas. For example, lumbar and knee support may be designed into the bed. Thus, altering the overall shape of the blank affects the way in which the hammock ultimately supports an occupant.

Forming the bed in the manner described above provides a bed upon which an occupant may rest in a level position. If the fabric is sufficiently long, the sides of the blank sufficiently tapered and the notches cut sufficiently deep, the entire height of a person may be supported on the level bed with room at each end of the hammock for deep storage compartments. The weight of the occupant on the bed is suspended and supported along the side edges of the hammock in a manner similar to a suspension bridge. The bed can provide level support as well as lumbar and knee support resulting in a more comfortable position for the occupant. The bed provides a lower center of gravity with respect to the side edges of the hammock providing greater stability even when the occupant moves around on the bed.

To keep the side edges of the hammock from caving-in, cross-braces may span the hammock from one side edge to the opposed side edge. Two or more cross-braces may be used. Preferably, two cross-braces proximal each end of the hammock are used. Each cross-brace is connected to the side edges of the hammock at connection points opposed across the bed from one side edge to the opposite side edge. The fabric hangs underneath the cross-braces so that an occupant may rest level on the bed fully under the cross-braces. The cross-braces are not connected to the fabric all along their length so that an occupant can rest beneath the cross-braces. The cross-braces function to separate the sides of the hammock and are not needed to support the fabric and the occupant. The cross-braces may be collapsible to facilitate set up, take down and storage of the hammock. The cross-braces may comprise any suitably rigid material, for example, wood, metal (e.g. aluminum or magnesium alloy), plastic, plastic composites, etc.

The sides of the blank or the side edges of the hammock may be reinforced to provide a stiffer rim for the hammock. The rim should still be flexible, but making the sides or side edges stiffer provides for stronger support for the occupant's weight and stronger connection points for the cross-braces. Reinforcement may be accomplished, for example, by using additional, stiffer material attached to the sides or side edges, or by attaching ropes, cables, wires, rods, etc, to the sides or side edges. Attachment may be conveniently accomplished by sewing, stapling, gluing, etc. Preferably, reinforcement comprises additional material (e.g. seat belt material) sewed onto or into the sides of the blank prior to forming the bed. Preferably, reinforcement is curved along the side edges between the cross-braces.

Connecting means at each end of the hammock are present for connecting the hammock to suspending means. Suspending means are used to suspend the hammock between upright structures. Preferably, the connecting means are located at the ends of the hammock where the side edges meet. These points may be further reinforced. Connecting means may be, for example, loops, rings, buckles or hooks attached directly to the hammock or to straps, ropes, cables or the like attached to the hammock. In a preferred embodiment, an excess length of strap is sewn onto the side edges of the hammock all around the rim to reinforce the side edges, with the excess length forming loops at each end of the hammock. Hooks, buckles or rings may be further connected to the loops. The hammock may be suspended between upright structures by means of suspending means, for example ropes, straps, cables and the like. One end of the suspending means is connected to the connecting means while the other end is connected to the upright structure. Upright structures may be, for example, trees, posts, walls with hooks, etc. Buckles, knots, hooks or other securing means may be used to secure the suspending means to the upright structure and/or connecting means.

A unique arrangement for connecting the hammock to the suspending means is also disclosed herein. In order to facilitate putting up and taking down the hammock, a quick-change connection system is desirable. To this end, a cargo hook having a hook portion and a ring portion is provided. The cargo hook acts as an intermediate connecting structure between the connecting means of the hammock and the suspending means. In this arrangement, the connecting means is a loop of flexible material and the suspending means is a rope, strap or cable having a loop at one end. The loops of the connecting means and the suspending means may be successively threaded through the ring portion of the cargo hook and looped over the hook portion to form quick, secure and easily reversed connections to the cargo hook.

Preferably, connection of the hammock's connection means to the cargo hook is performed last so that the hammock may be disconnected from the cargo hook without having to disconnect the suspending means from the cargo hook. In this way, the hook is less likely to get lost as it can be stored while remaining attached to the suspending means. Additionally, the hammock can then be quickly folded and stored without the hook since the hook may damage the fabric of the hammock if it is stored together with the hammock. Also, the suspending means with the hook can be removed and/or replaced without affecting the hammock.

A special securing means for securing the suspending means to the upright structure may be used. With most hammocks, the suspending means is a rope, cable or strap that is tied around the upright structure (e.g. a tree, post, etc.) and knotted in place. Such an arrangement is difficult to do and undo and is not amenable to adjustment once secured. In many instances, it is desirable to be able to adjust the length of the suspending means without having to undo it from the upright structure. To this end, the suspending means is preferably a flat strap with a cam buckle that permits adjustment of the strap without removing the strap from the upright structure. In operation the strap is normally wrapped around the upright structure and an end of the strap fed through an opening in the housing of the cam buckle. Normally, the end of the strap that is fed through is the one closest to where the buckle will be so that time is not wasted feeding great lengths of strap through the buckle. However, when a cargo hook is connected to one of the strap, only one end of the strap is free, unless the cargo hook is removed, which is also a waste of time.

Since there is great variability in the possible distances between upright structures, great lengths of strap are required to ensure that the hammock can be set up in many different places. Thus, a quick and simple way of introducing the buckle to or removing the buckle from any location along the strap is greatly desired. To facilitate this, the cam buckle is advantageously provided with a narrow slot in the housing so that the strap can be fed edgewise into the opening of the housing. In this way, the cam buckle can be quickly and easily introduced on and/or removed from the strap at any location along the strap, greatly decreasing the time required to set up and to take down the hammock.

The hammock of the present invention may also be provided with a bug screen and/or a tent. The bug screen may take the form of a mesh tube open at both ends that slides over and surrounds the hammock. The bug screen may also comprise additional sections that overlap with the mesh tube and close off one or both ends in order to completely enclose the hammock. The bug screen may be attached to the hammock or the tent, for example with Velcro™, snaps, ties, etc., to help keep the bug screen in place once it is set up.

The tent may comprise several overlapping sections that fit around the hammock. The bug screen and the tent may be used in combination and a single supporting system supports the bug screen and the tent, whether they are used separately of together.

The bug screen and the tent are supported by a supporting system that comprises two or more side supports, one or more ridge supports and two or more suspension supports. Preferably two side supports, one for each side, one ridge support and two suspension supports, one for each end, are used. The supports are preferably straps. One end of each side support, one end of the ridge support and one end of one of the suspension supports meet and are connected at a nexus located at one end of the supporting system. A similar nexus is present at the other end of the support system. When the support are straps, the nexus may be a ring structure to which the straps are attached. The suspension supports are secured to upright structures to keep the support system off the ground and in position to support the bug screen and/or tent around the hammock.

The side and/or ridge supports may be adjustable to increase or decrease tension on the bug screen and/or tent that they support. This facilitates entering and exiting the hammock when the tent is used since the tent is preferably tensioned to provide more space when the hammock is occupied, but is preferably not tensioned when the occupant is entering and exiting the hammock so that the tent does not get in the way. The side and/or ridge supports may further have one or more pockets attached thereto for storing items.

The tube-shaped bug screen may be fitted over the side and ridge supports like a sock fit over a foot. The side and ridge supports keep fabric of the bug screen from collapsing in on the occupant of the hammock. The tent may be used together with or separately from the bug screen. When used with the bug screen, the tent fits over the bug screen so that the bug screen is inside the tent.

The tent preferably comprises several separate overlapping covers, e.g. a foot cover, a head cover, a ridge vent cover and one or more mesh vents. The foot and head covers are generally tube-shaped and fit over the supporting system and around the hammock. The foot and head covers meet and overlap proximal the middle of the hammock thereby completely surrounding the hammock. The foot and/or head covers may have one or more vents. Preferably, there is both a top and a bottom vent. The ridge vent cover preferably fits over the foot and head covers and is able to cover or be removed from the top event when desired. The covers may be connected together, for example, by means of snaps, ties or Velcro™.

A door is provided in the tent to permit an occupant to enter and exit the hammock. The door advantageously arises from the use of separate foot and head covers. The foot and/or the head cover may be provided with a flap that may be moved to open a portal in a side of the tent proximal where the foot and head covers overlap. Preferably, the flap is equipped with means, for example, snaps, ties or Velcro™, for securing the flap in a closed position.

Advantageously, the tent is adaptable to be a stretcher, particularly if the ridge support is sufficiently rigid, for example if the ridge support is a pole.

The hammock and its components together with the bug screen, tent and supporting system may be sold as a kit. Instructions for set up and take down may accompany the kit. The kit may include a rain fly.

A hammock of the present invention offers a number of advantages over prior art hammocks. The hammock is more portable, being easier to put up and take down and lighter in weight. It is more stable permitting an occupant to move around without fear of tipping and permitting an occupant to sleep on his/her side. The hammock is more comfortable as it provides a level surface, with the added benefit of lumbar and knee support. The deep storage spaces at the ends of the hammock permit an occupant to store gear in the hammock off the ground, and out of the rain if a tent embodiment is used. The tent embodiment provides a quick, light weight way of getting out of the rain. Interior ventilation adjustment permits ventilation without having to exit the hammock. That the tent and bug screen are separate structures from each other and the hammock permits the use of the hammock with or without the tent or bug screen, and permits the owner of the hammock to upgrade at a later date.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which:

FIG. 3A is a schematic view of the hammock of FIG. 1 showing lines of support;

FIG. 3B is a schematic view of a prior art hammock showing lines of support;

DESCRIPTION OF PREFERRED EMBODIMENTS

Figure 1:
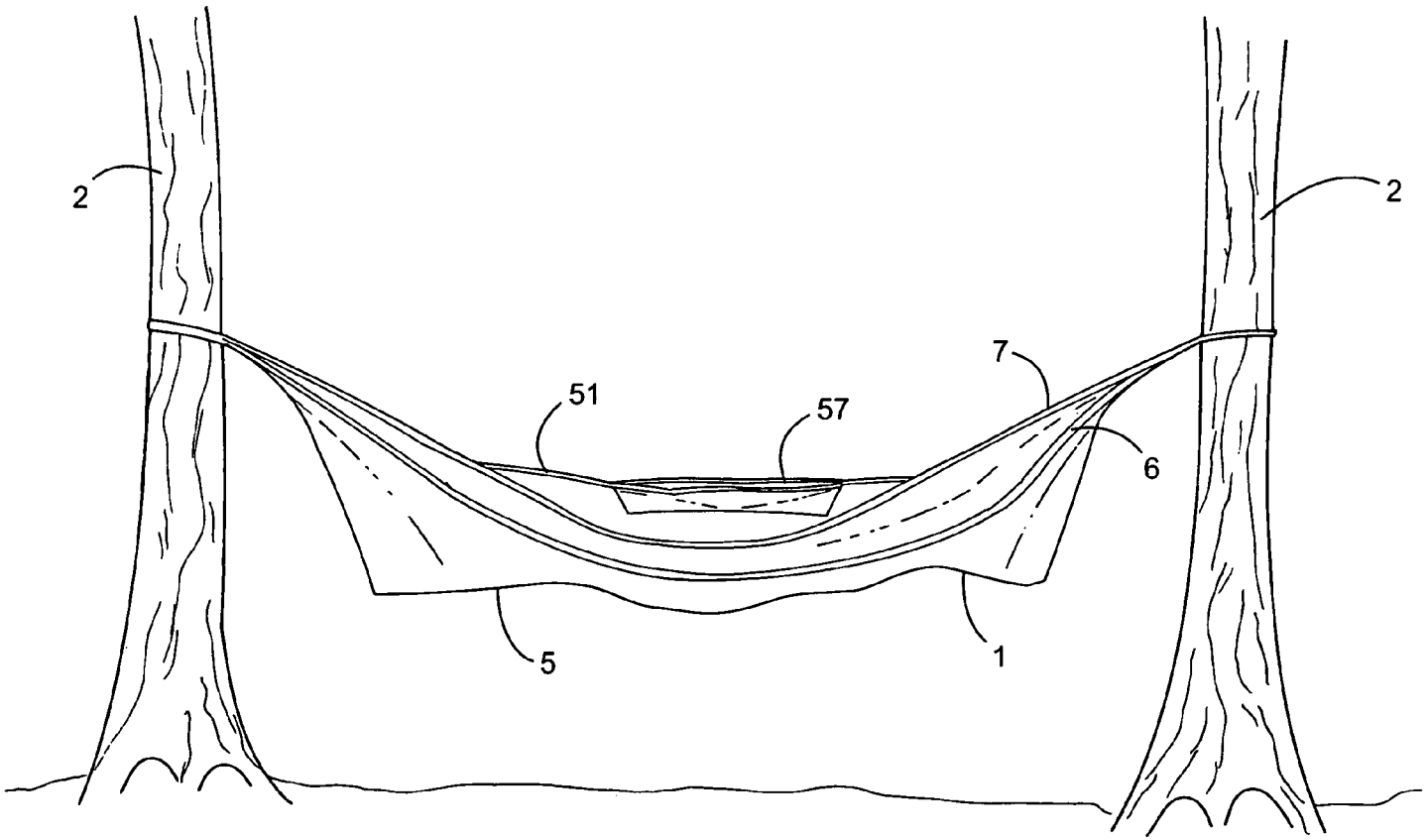
FIG. 1 is a side view of a hammock of the present invention suspended between two trees.

Referring to FIG. 1, hammock 1 of the present invention is suspended off the ground between two trees 2. Hammock 1 comprises level bed 5 made of a durable waterproof polyester fabric. Side edges 6,7 of the hammock are reinforced with seat belt material to provide a stiffer yet flexible support for the fabric including bed 5. Hammock 1 is shown with side strap 51 having pocket 57.

Figure 2:
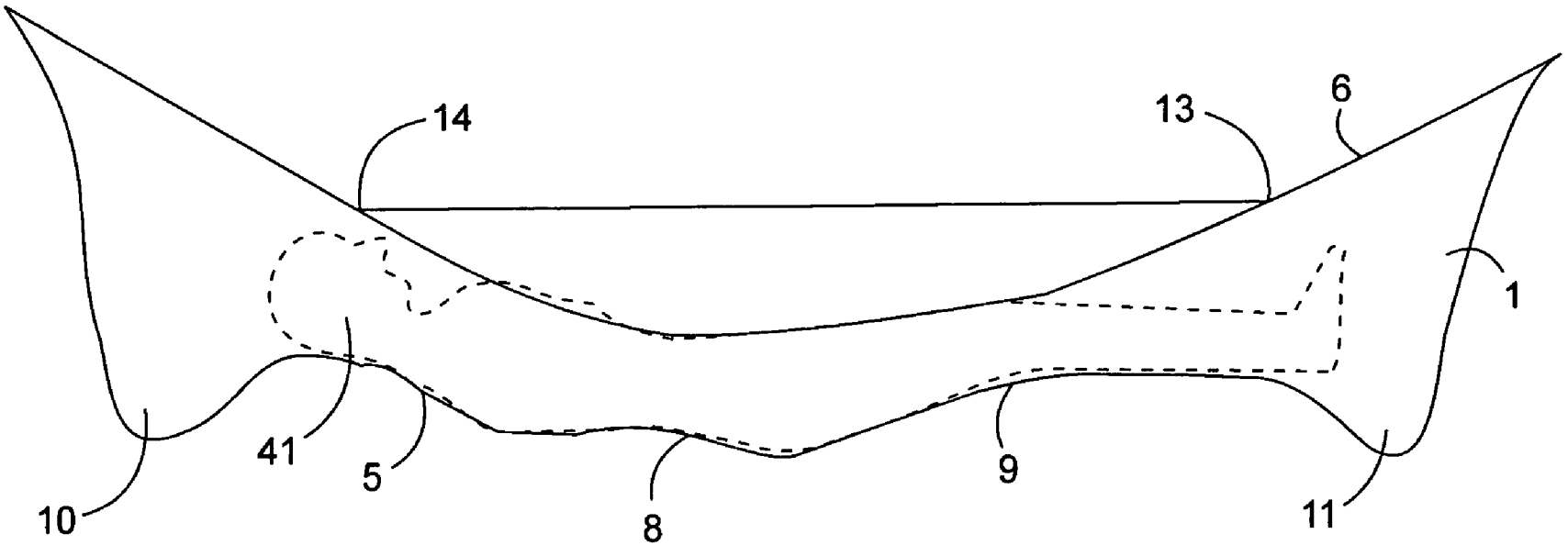
FIG. 2 is a side schematic view of the hammock of FIG. 1 having a person lying therein.

Referring to FIG. 2, a side schematic view of hammock 1 has a person 41 lying therein. Bed 5 of hammock 1 provides excellent lumbar support at 8 and knee support at 9 while permitting person 41 to lie in a generally level position below cross-braces (not shown) connected to side edge 6 at points 13,14. Storage compartments 10,11 in bed 5 are located at the head end and foot end of the hammock.

FIG. 3 compares hammock 1 (FIG. 3A) to a prior art hammock 100 (FIG. 3B). In hammock 1, fabric of bed 5 is supported from side edges 6,7 and is connected to cross-braces 17,18 only at ends 21,22,23,24 of the cross-braces. The fabric thus lies underneath cross-braces 17,18 and a person can lie flat under the cross-braces. In contrast, fabric of bed 105 of prior art hammock 100 is attached all along cross-braces 117,118. Therefore, a person lying in hammock 100 cannot lie flat and must assume a V-shape. Lines of force are shown in broken lines. In hammock 1, the lines of force on bed 5 are from side to side; thus, bed 5 is supported from side edges 6,7, not cross-braces 17,18. In contrast, prior art hammock 100 has lines of force from end to end; thus, bed 105 is supported from cross-braces 117,118. Cross-braces 17,18 function to separate side edges 6,7 and do not support bed 5. Therefore, cross-braces 17,18 may be collapsible having breakdown joints 25,26 to facilitate packing and storage of the hammock.

Figure 4A:
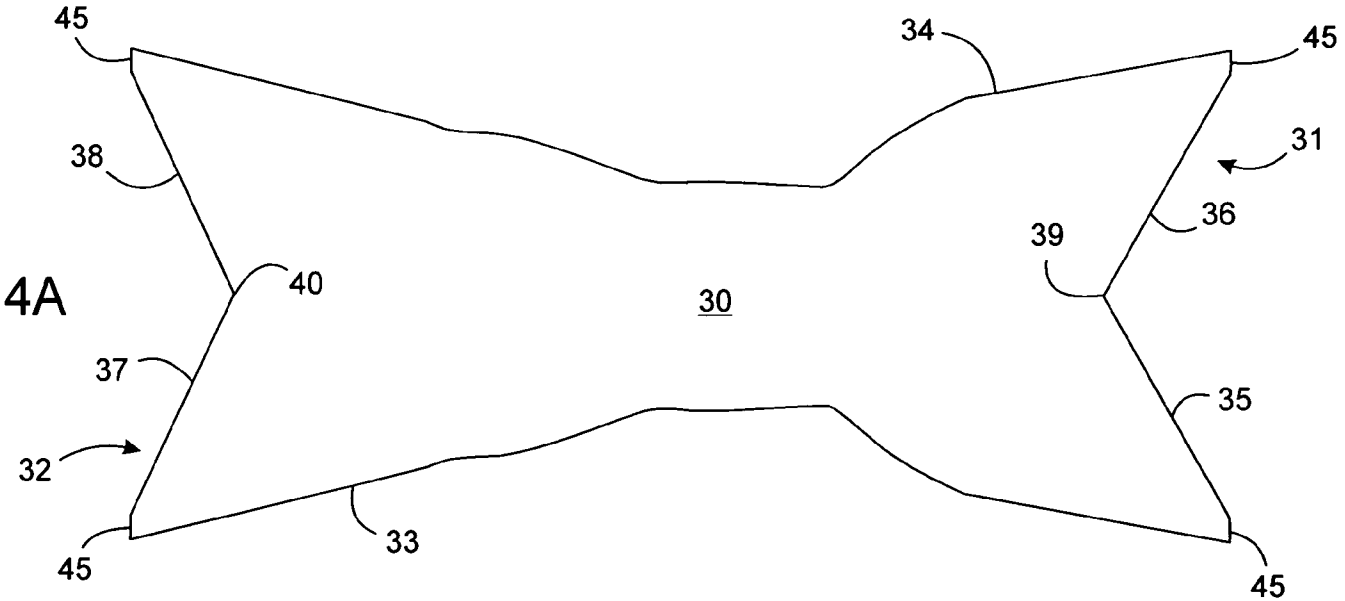
FIG. 4A is a plan view of a blank for forming a bed of the hammock depicted in FIG. 1.
Figure 4B:
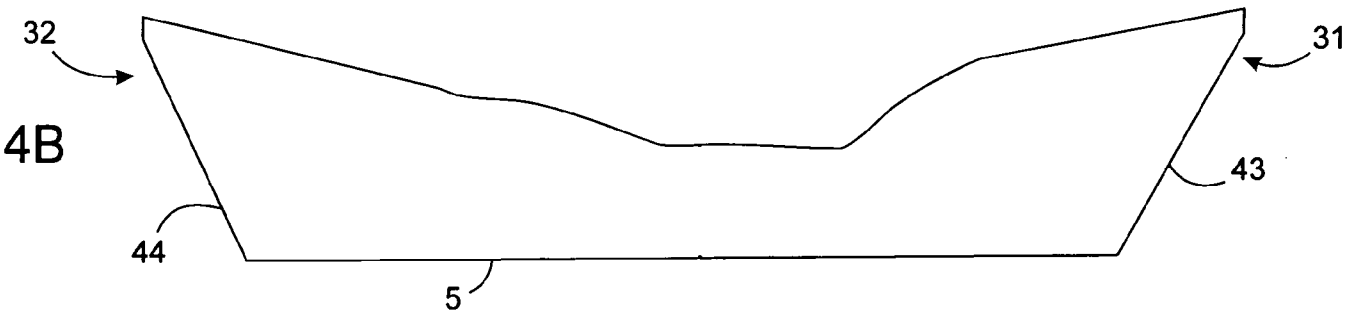
FIG. 4B is a side schematic view of the blank of FIG. 4A after being sewn along opposed edges of each notch.

Referring to FIG. 4, the hammock of the present invention is can be further distinguished from prior art hammocks, including other so-called self-leveling hammocks by virtue of the way in which the bed is made from a blank of fabric. FIG. 4A depicts a blank 30 of polyester fabric having opposed ends 31,32 and opposed sides 33,34. Each side 33,34 of blank 30 tapers inwardly from ends 31,32. Each end 31,32 has a notch having opposed edges 35,36 and 37,38. Edge 35 is equal in length to edge 36. Edge 37 is equal in length to edge 38. Edges 35,36 are not equal in length to edges 37,38. The opposed edges of each notch taper inwardly from the ends towards apexes 39,40. Sides 33,34 are scalloped. Such scalloping provides the lumbar and knee support once seams are sewn attaching edge 35 to edge 36 and edge 37 to edge 38 to form the bed from blank 30. Ends 31,32 at 45 are not sewn together. FIG. 4A depicts a side view of bed 5 once seams 43,44 are sewn. Sides 33,34 are reinforced by sewing seat belt material along the sides. One continuous length of seat belt material sewed together at its ends is used to provide stiffened side edges of the hammock. Since the ends at 45 are not sewn together, loops at each end are formed bounded by the seat belt material and the seams. Such loops are used to connect the hammock to suspending means.

Figure 5:
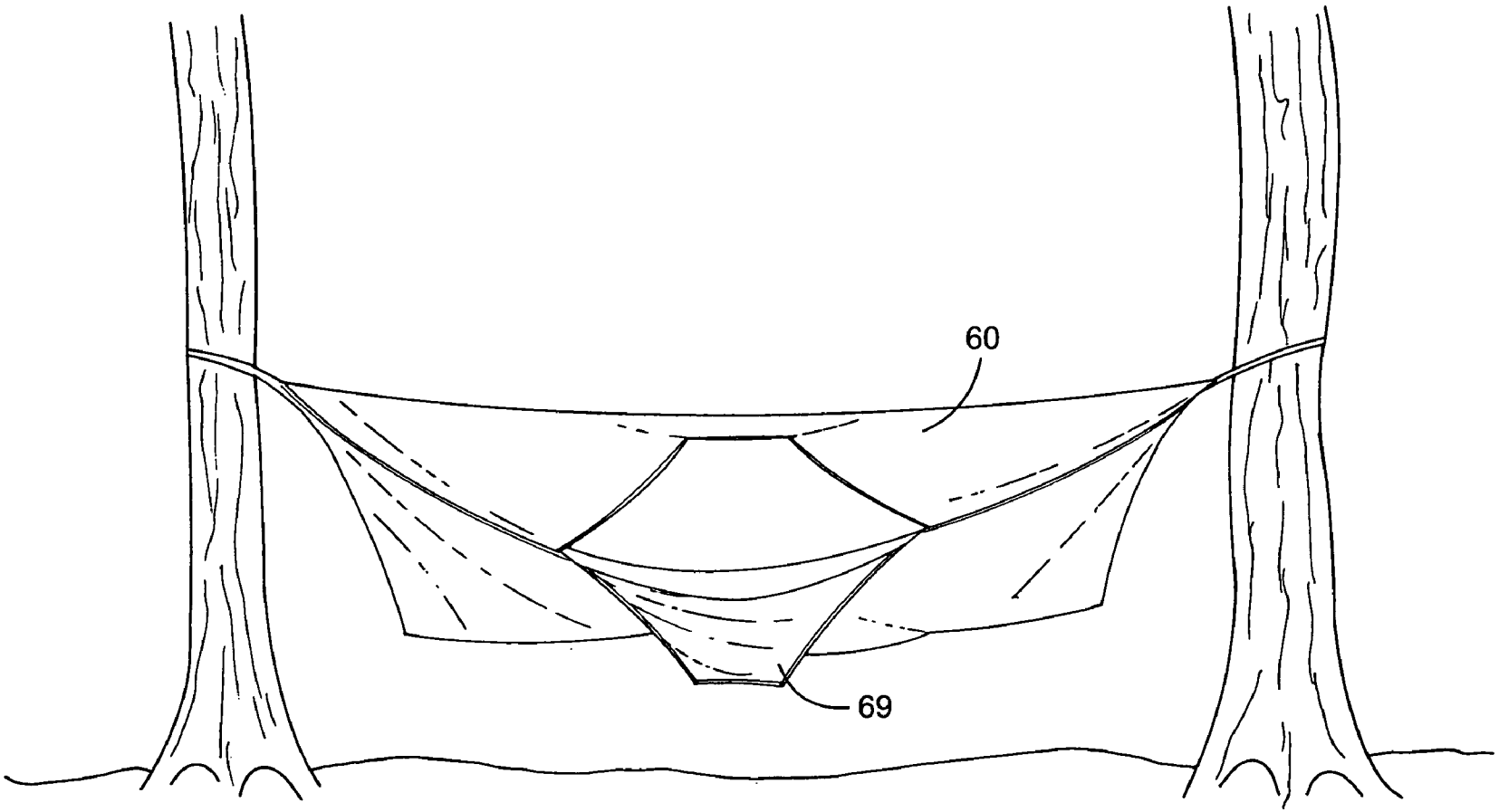
FIG. 5 is a side view of the hammock of FIG. 1 in combination with a tent having an open door.
Figure 6:
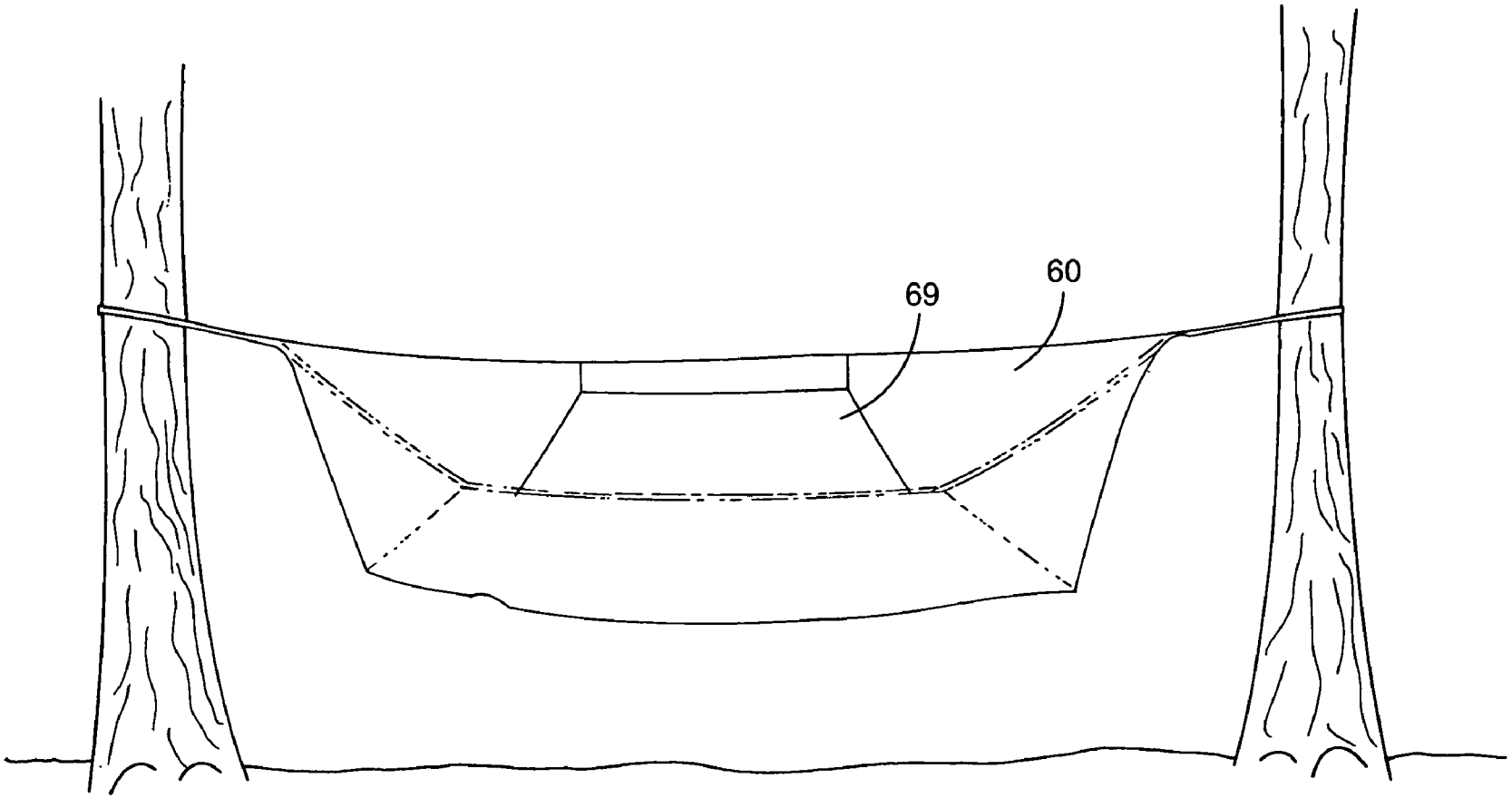
FIG. 6 is a side view of the hammock of FIG. 1 in combination with a tent having an closed door.

Referring to FIGS. 5 and 6, a hammock is shown in combination with a tent 60. Tent 60 completely surrounds the hammock and the tent has flap 69 that serves as a door. The door may be open (FIG. 5) or closed (FIG. 6).

Figure 7:
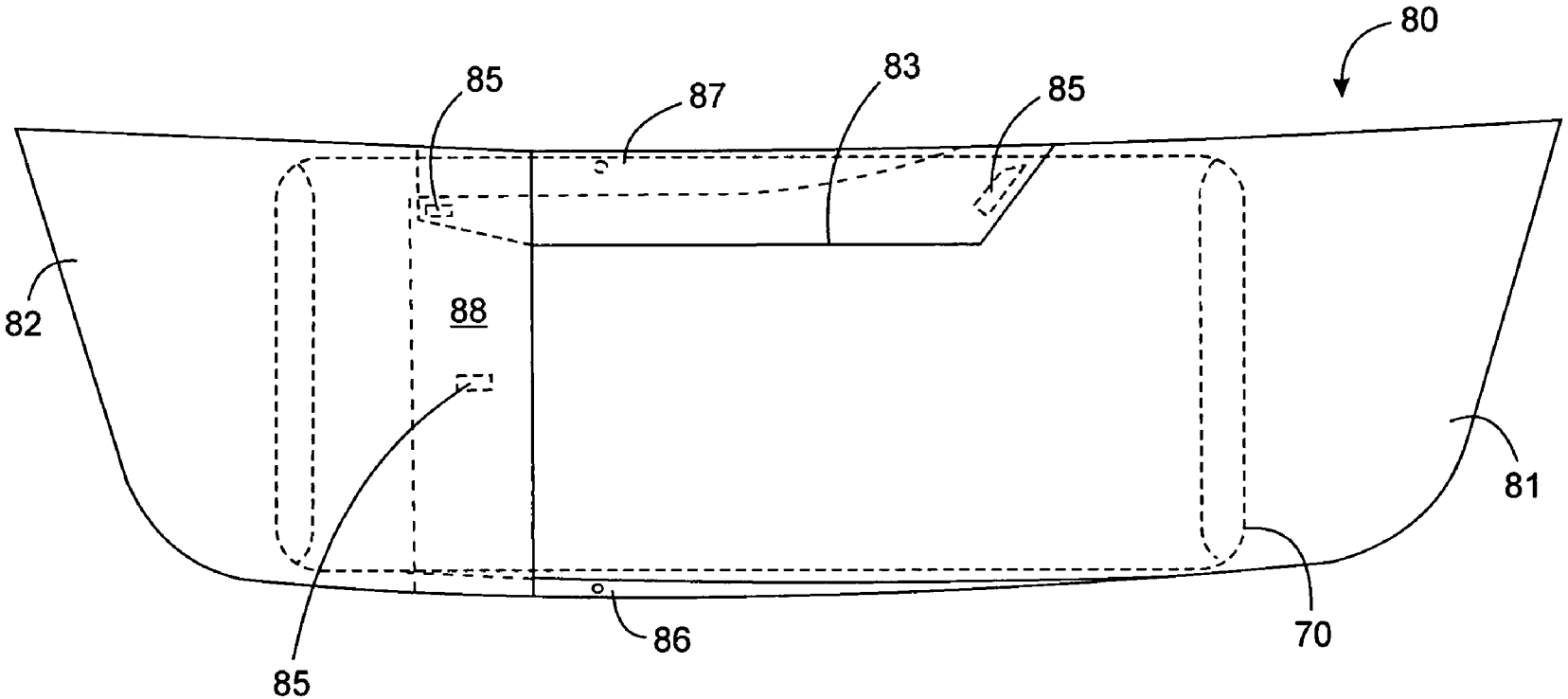
FIG. 7 is a side schematic view of an alternate embodiment of a tent for use with a hammock of FIG. 1.

Referring to FIG. 7, in an alternate embodiment, tent 80 comprises overlapping sections. Generally tubular foot cover 81 and generally tubular head cover 82 that surround the hammock (not shown) overlap in region 88. Foot cover 81 comprises bottom vent 86 and top vent 87. Bottom vent 86 is covered by a mesh vent cover. Top vent 87 is covered by ridge vent cover 83. Foot cover 81, head cover 82 and ridge vent cover 83 are held together by Velcro™ 85. Generally tubular bug screen 70 open at both ends surrounds the hammock and is between the hammock and tent 80.

Figure 8:
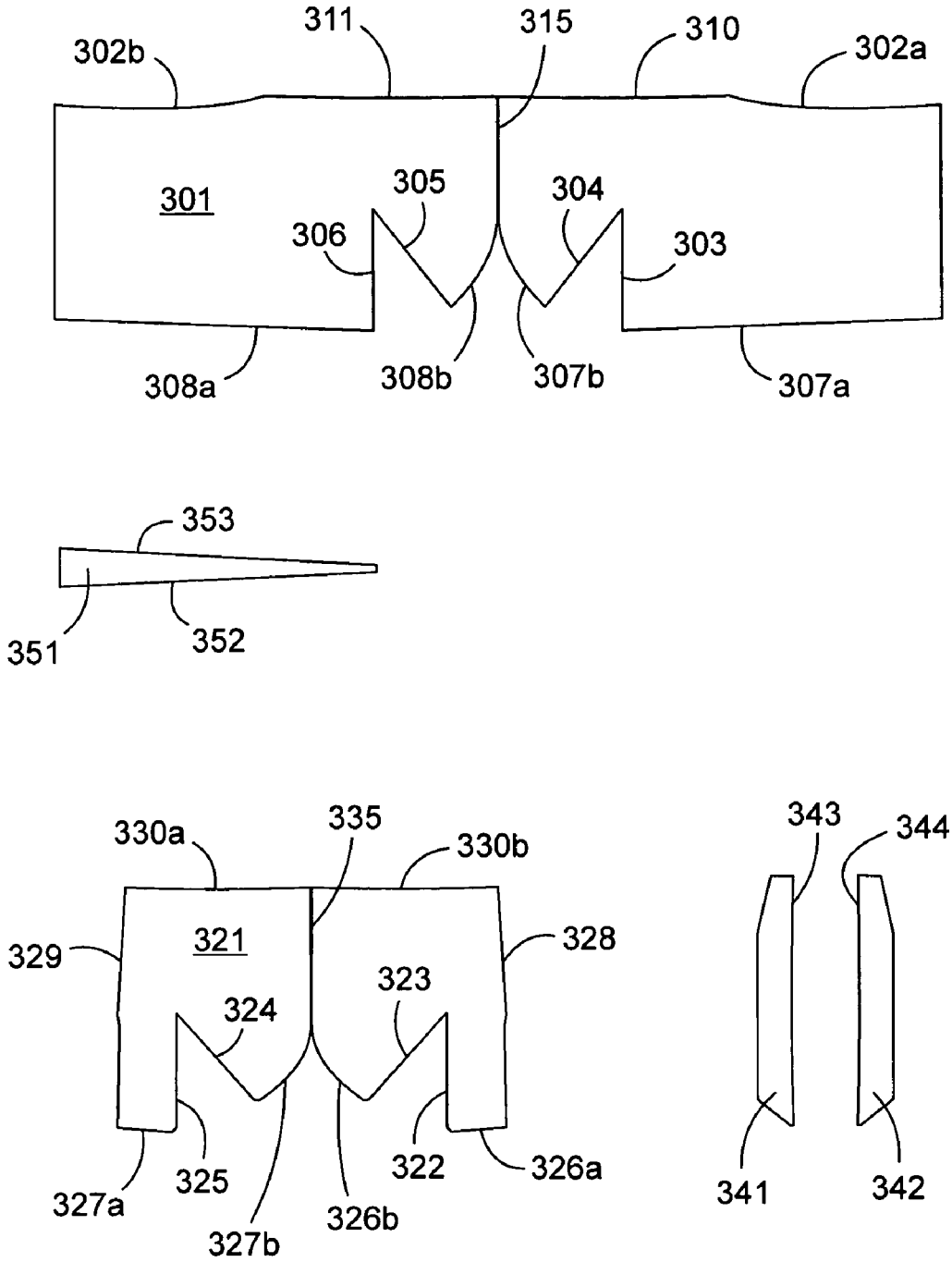
FIG. 8 is a plan view of blanks for forming a foot cover, a head cover, a ridge vent cover and a mesh vent for the tent depicted in FIG. 7.

FIG. 8 depicts blanks for forming the various parts of the tent depicted in FIG. 7. The foot cover is formed from foot cover blank 301 by finishing edges 302*a* and 302*b* on a sewing machine and sewing edges 310 and 311 together so that blank 301 folds along fold line 315. Edges 303 and 304 are sewed together and edges 305 and 306 are sewed together. Edges 307*a* and 307*b* form one edge when edges 303 and 304 are sewn together and edges 308*a* and 308*b* form one edge when edges 305 and 306 are sewn together. Edges 307*a,b* and 308*a,b* are sewed to edges 352 and 353, respectively, of mesh vent cover 351. The mesh vent cover covers the bottom vent which is formed by an airspace between edges 307*a,b* and 308*a,b*. An airspace between edges 302*a* and 302*b* provides for the top vent, which is located under the ridge vent cover when the tent is set up.

Still referring to FIG. 8, the head cover is formed from head cover blank 321 by sewing edge 322 to edge 323 and edge 324 to 325. Sewing edge 322 to edge 323 creates a single edge from edges 326*a* and 326*b*, and sewing edge 324 to edge 325 creates a single edge from edges 327*a* and 327*b*. Single edge 326*a,b* is sewed to single edge 327*a,b*. Edge 328 is sewed to edge 329 so that head cover blank 321 is folded along fold line 335. Edges 330*a* and 330*b* are finished on a sewing machine.

Still referring to FIG. 8, the ridge vent cover is formed from two ridge vent cover blanks 341 and 342 by sewing edge 343 to edge 344. All other edges are finished on a sewing machine.

Figure 9A:
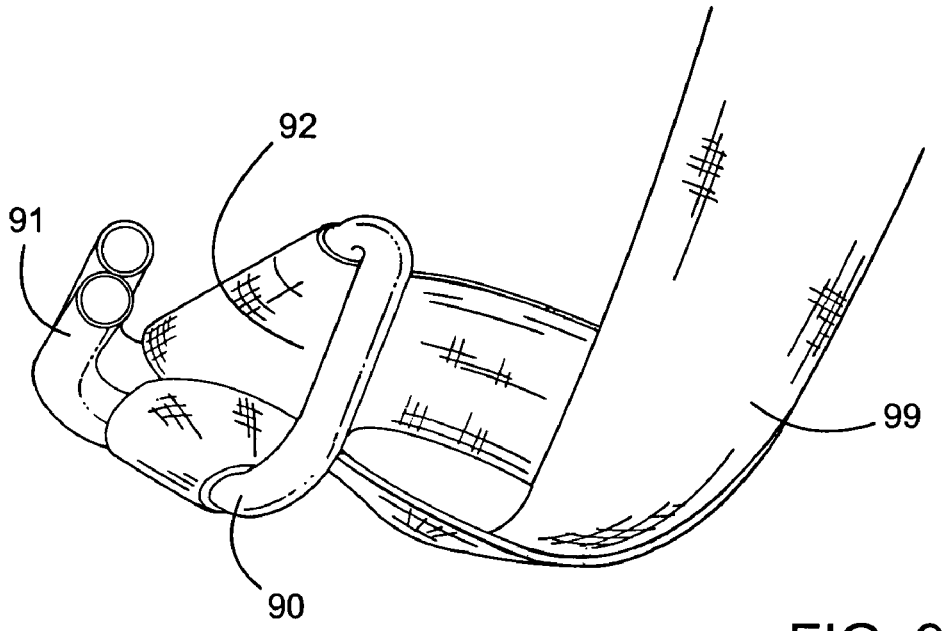
FIG. 9A is a perspective view of a cargo hook having a suspending strap threaded therethrough.
Figure 9B:
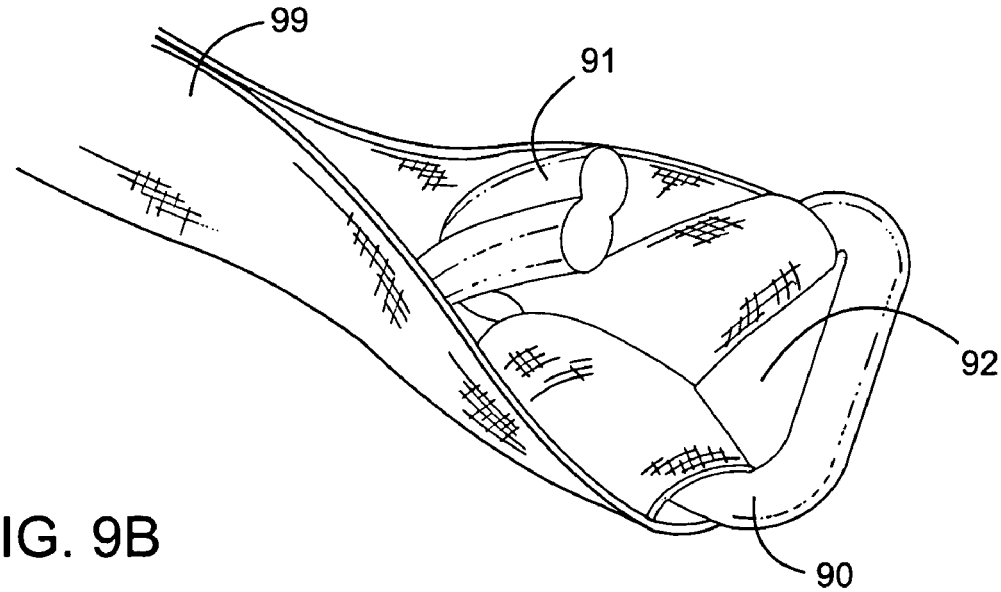
FIG. 9B is an alternate perspective view of the cargo hook of FIG. 9A with the suspending strap in a suspending orientation.
Figure 10A:
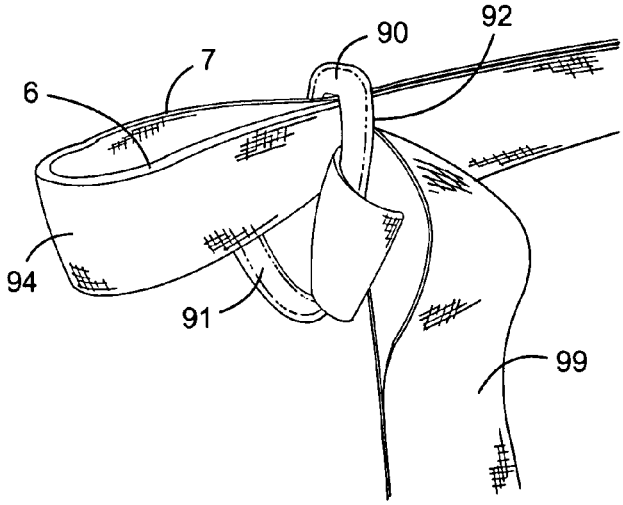
FIG. 10A is a perspective view of the cargo hook of FIG. 9B with a hammock's connecting loop threaded therethrough.
Figure 10B:
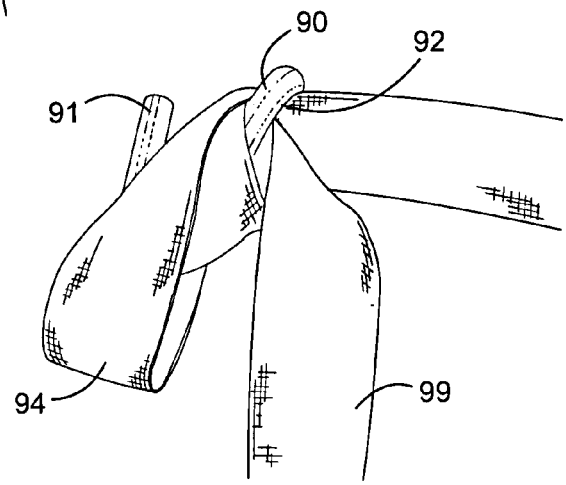
FIG. 10B depicts the cargo hook of FIG. 10A with the connecting loop hooked over the cargo hook.
Figure 10C:
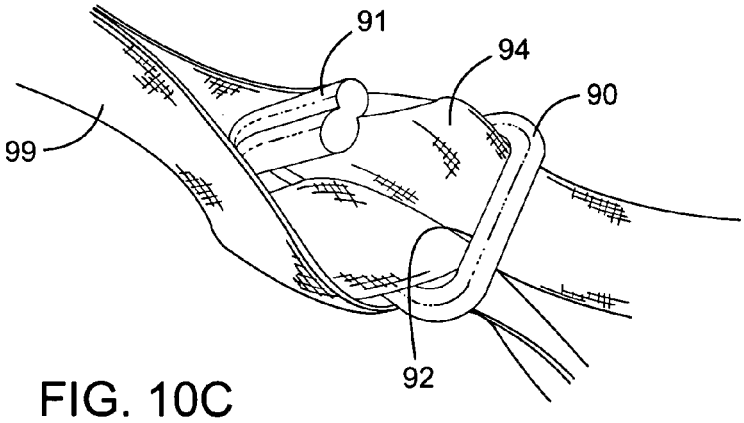
FIG. 10C is the cargo hook of FIG. 10B with the suspending strap and the connecting loop in their fully supporting positions.

FIGS. 9 and 10 illustrate how the hammock of the present invention may be connected to suspending means. As seen in FIGS. 9A and 9B, flat suspending strap 99 having a loop in one end is inserted through ring portion 92 of cargo hook 90 and then looped around hook portion 91 of cargo hook 90. Cargo hook 90 is then nested within the loop of suspending strap 99 to provide further access to ring portion 92 (see FIG. 9B). As seen in FIGS. 10A–10C, loop 94 formed by side edges 6,7 of the hammock is then inserted through ring portion 92 of cargo hook 90 and looped over hook portion 91. The hammock is now connected to suspending strap 99 by means of cargo hook 90 as depicted in FIG. 10C. Since loop 94 was last to be inserted, it is first to be removed, thus cargo hook 90 can remain connected to suspending strap 99 for storage when the hammock is taken down.

Figure 11:
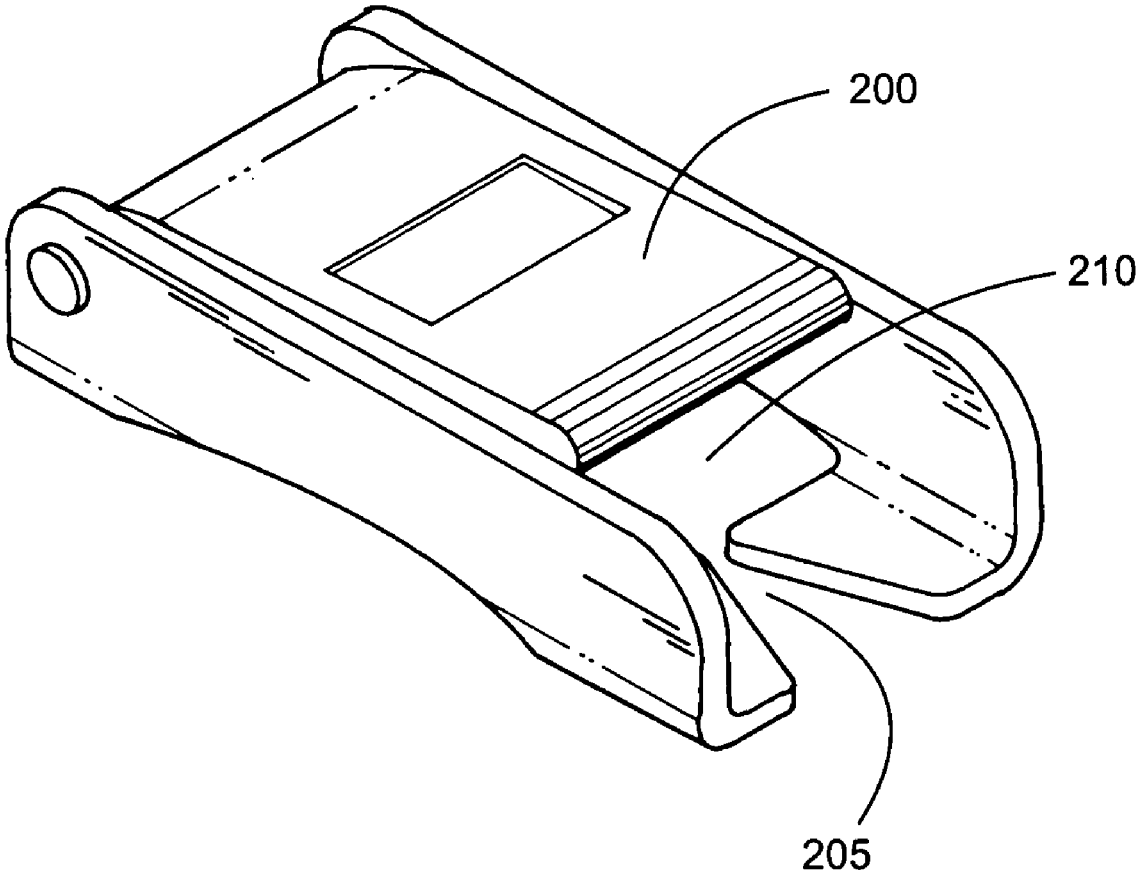
FIG. 11 is a perspective view of a cam buckle of the present invention.
Figure 12A:
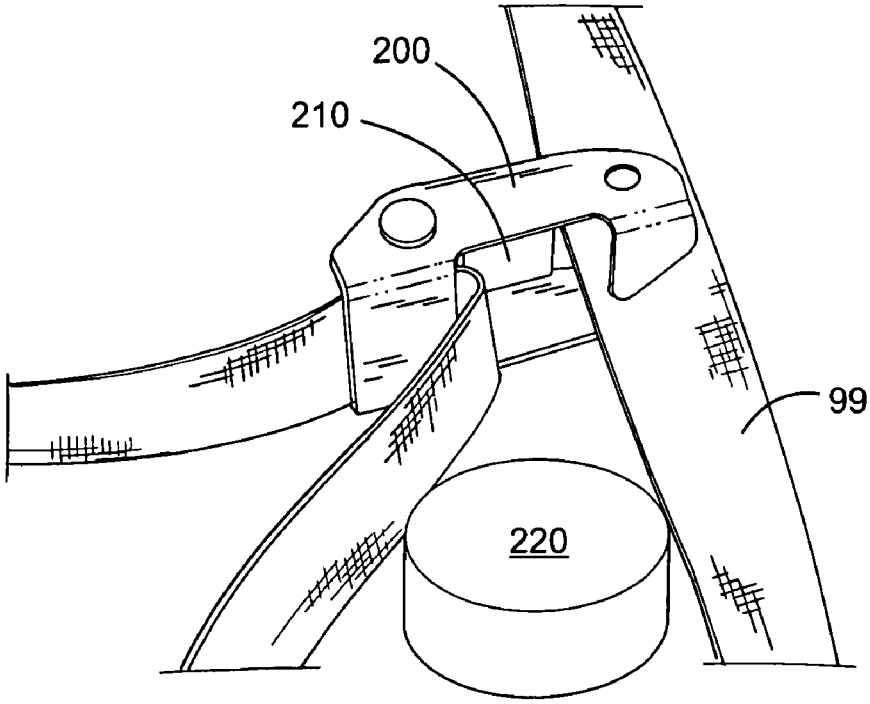
FIG. 12A is a perspective view of a suspending strap being inserted into the cam buckle of FIG. 11; and, FIG. 12B depicts the cam buckle in FIG. 12A with the suspending strap threaded therein and surrounding a post.
Figure 12B:
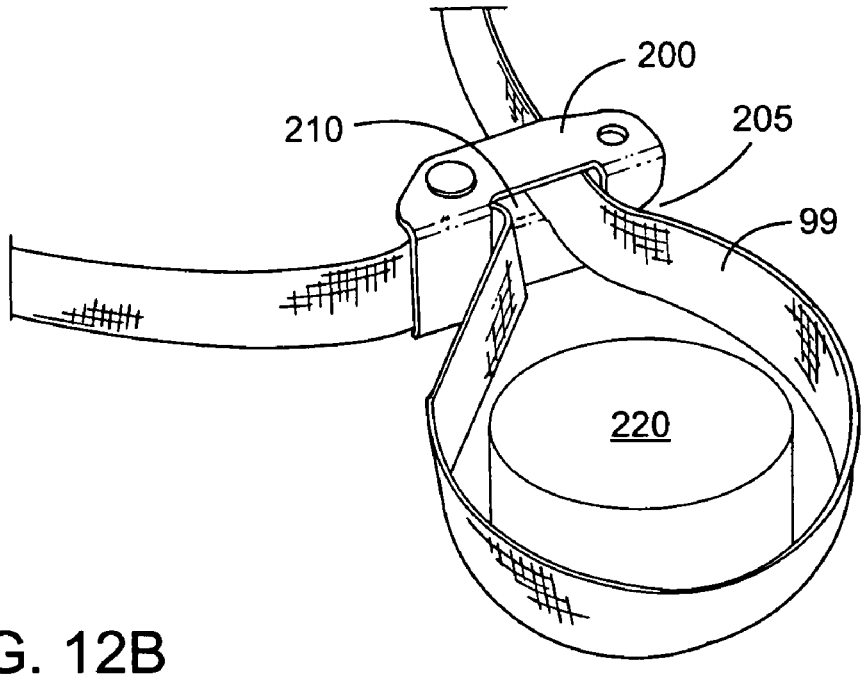

FIGS. 11–12 depict a way in which suspending strap 99 is secured to an upright structure. Cam buckle 200 is provided having slot 205 through which an edge of suspending strap 99 may be inserted in order to insert the strap into aperture 210 of cam buckle 200. Thus, strap 99 can be wrapped around upright structure 220 at the appropriate length and quickly inserted into cam buckle 200 without having to feed strap 99 through aperture 210 all the way from an end of the strap. Unwrapping suspension strap 99 from upright structure 220 is just as easily done in reverse.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A hammock comprising:

a bed formed from a blank of flexible fabric, the blank defined by opposed ends and opposed sides, the ends and sides of the blank coinciding with opposed ends and opposed side edges of the hammock respectively, each side of the blank tapering inwardly from the ends, each end of the blank having a notch having opposed edges of equal length, the opposed edges of each notch tapering inwardly from the end towards an apex, a seam attaching the opposed edges of each notch to form the bed from the blank;

cross-braces proximal the ends of the hammock, each cross-brace connected to the side edges of the hammock at connection points opposed across the bed from one side edge to the opposite side edge, the fabric hanging underneath the cross-braces so that an occupant may rest level on the bed fully under the cross-braces; and, connecting means at each end of the hammock for connecting the hammock to suspending means for suspending the hammock between upright structures.

2. The hammock of claim 1, wherein the connecting means comprises a loop of material formed by an excess length of the side edges.

3. The hammock of claim 2, wherein the connecting means is connected to the suspending means by a cargo hook having a hook portion and a ring portion, the suspending means is threaded through the ring portion of the cargo hook and looped over the hook portion and the connecting means is threaded through the ring portion of the cargo hook and looped over the hook portion.

4. The hammock of claim 3, wherein the suspending means comprises a flat strap and a securing means for securing the flat strap to the upright structure, the securing means comprising a cam buckle having a housing and a slot in the housing for inserting an edge of the flat strap into the cam buckle.

5. The hammock of claim 4, wherein the side edges of the hammock are reinforced with material sewn on to the sides of the blank.

6. The hammock of claim 5, wherein the cross-braces are collapsible.

7. The hammock of claim 1, wherein all or a portion of the sides of the blank are scalloped.

8. The hammock of claim 6, wherein all or a portion of the sides of the blank are scalloped.

9. A covered hammock comprising the hammock of claim 1 covered by a tent and/or bug screen.

10. The covered hammock of claim 9, wherein the tent and/or bug screen is supported on the tent by a supporting system comprising two or more side supports, one or more ridge supports and two or more suspension supports.

11. The covered hammock of claim 10, wherein the two or more side supports is two side straps, the one or more ridge supports is one ridge strap and the two or more suspension supports is two suspension straps, and wherein the side straps, ridge strap and suspension straps meet and are connected at two nexuses, one nexus located at one end of the supporting system and the other nexus located at another end of the supporting system.

12. The covered hammock of claim 10, wherein the tent comprises overlapping sections that fit around the hammock.

13. The covered hammock of claim 12, wherein one of the overlapping sections comprises a foot cover and a head cover, the foot cover and/or the head cover comprising a flap that is movable to open a portal in a side of the tent proximal where the foot and head covers overlap.

14. The covered hammock of claim 10, wherein the bug screen comprises a mesh tube that slides over the hammock.

15. A hammock comprising:

a bed formed from a blank of flexible fabric, the blank defined by opposed ends and opposed sides, the ends and sides of the blank coinciding with opposed ends and opposed side edges of the hammock respectively, each side of the blank scalloped and tapering inwardly from the ends, each side edge of the hammock reinforced with material sewn on to the sides of the blank, each end of the blank having a notch having opposed edges of equal length, the opposed edges of each notch tapering inwardly from the end towards an apex, a seam attaching the opposed edges of each notch to form the bed from the blank;

two collapsible cross-braces, one of the cross-braces proximal one end of the hammock, the other of the cross-braces proximal the other end of the hammock, each cross-brace connected to the side edges of the hammock at connection points opposed across the bed from one side edge to the opposite side edge, the fabric hanging underneath the cross-braces so that an occupant may rest level on the bed fully under the cross-braces; and, connecting means at each end of the hammock comprising a loop of material formed by an excess length of the side edges for connecting the hammock to suspending means for suspending the hammock between upright structures.

16. The hammock of claim 15, wherein the loop is connected to the suspending means by a cargo hook having a hook portion and a ring portion, the loop threaded through the ring portion of the cargo hook and looped over the hook portion, the suspending means comprising a flat strap threaded through the ring portion of the cargo hook and looped over the hook portion, the suspending means further comprising a securing means for securing the flat strap to the upright structure, the securing means comprising a cam buckle having a housing and a slot in the housing for inserting an edge of the flat strap into the cam buckle.

17. A kit comprising a hammock according to claim 1, suspending means for suspending the hammock between upright structures, a supporting system for a tent and/or a bug screen and instructions for assembling the hammock, suspending means and supporting system.

18. The kit of claim 17 further comprising a tent and/or a bug screen, the tent comprising separate overlapping sections that fit around the hammock, the overlapping sections comprising a foot cover and a head cover, the foot and/or head cover comprising a flap that is movable to open a portal in a side of the tent proximal where the foot and head cover overlaps, the bug screen comprising a mesh tube that slides over the hammock.

19. A kit comprising a hammock according to claim 15, suspending means for suspending the hammock between upright structures, a supporting system for a tent and/or a bug screen and instructions for assembling the hammock, suspending means and supporting system.

20. The kit of claim 19 further comprising a tent and/or a bug screen, the tent comprising separate overlapping sections that fit around the hammock, the overlapping sections comprising a foot cover and a head cover, the foot and/or head cover comprising a flap that is movable to open a portal in a side of the tent proximal where the foot and head cover overlaps, the bug screen comprising a mesh tube that slides over the hammock.

* * * * *